United States Patent [19]

Morton

[11] 4,106,249

[45] Aug. 15, 1978

[54] METHOD AND APPARATUS FOR INTERLOCKING AND VENTING A STRUCTURAL DIAPHRAGM

[75] Inventor: Virgil R. Morton, Redondo Beach, Calif.

[73] Assignee: Verco Manufacturing, Inc., Phoenix, Ariz.

[21] Appl. No.: 811,607

[22] Filed: Jun. 30, 1977

[51] Int. Cl.[2] ..... E04B 1/16

[52] U.S. Cl. ..... 52/336; 52/221; 52/450

[58] Field of Search ..... 52/450, 576, 577, 503, 52/220, 221, 302, 336, 636

[56] References Cited

U.S. PATENT DOCUMENTS

| | | | |
|---|---|---|---|
| 3,496,691 | 2/1970 | Seaburg | 52/336 |
| 3,609,210 | 9/1971 | Guritz | 52/221 |
| 3,715,844 | 2/1973 | Breading | 52/221 |
| 3,884,009 | 5/1975 | Frohlich et al. | 52/302 |
| 3,932,696 | 1/1973 | Fork et al. | 52/221 |

FOREIGN PATENT DOCUMENTS

| | | | |
|---|---|---|---|
| 2,325,281 | 12/1973 | Fed. Rep. of Germany | 52/336 |

*Primary Examiner*—J. Karl Bell

*Attorney, Agent, or Firm*—Cahill, Sutton & Thomas

[57] ABSTRACT

A fluted deck for use in the building industry includes a plurality of vents disposed within the webs interconnecting top and bottom flutes. Since the webs are proportionally stronger than the top and bottom flutes, the vents do not reduce the inherent strength of the deck. The vents are inwardly oriented louvers longitudinally aligned with the troughs developed in the deck. When concrete fill is poured upon the deck and particularly when the concrete fill is covered by non-porous insulating material, the vents promote and insure more uniform and more complete curing than unvented deck. The inwardly directed louvers form recesses or depressions within the concrete fill to physically interlock the deck with the concrete fill and form a high strength unitary diaphragm for buildings.

19 Claims, 4 Drawing Figures

METHOD AND APPARATUS FOR INTERLOCKING AND VENTING A STRUCTURAL DIAPHRAGM

The present invention relates to components for buildings and, more particularly, to diaphragms.

Corrugated or fluted sheets of metal are widely used as the supporting elements for floor decks or diaphragms. Generally, a filler material is attached to or poured upon the corrugated sheets to develop a smooth surface. Often vents or apertures are disposed at the bottom of the troughs of the corrugated sheet or within the bottom flutes to evacuate water and water vapor when a concrete fill is employed, as exemplified in U.S. Pat. Nos. 1,029,864 and 3,245,186. Similarly, vent holes may be provided in the troughs of the corrugated sheet, which sheet defines a form for concrete reinforced structures, as illustrated in U.S. Pat. No. 1,480,129. A metallic corrugated sheet having vents disposed in both the bottom and top flutes is described in U.S. Pat. No. 447,085. A widely used standard venting system disposed at the junction of adjacent corrugated sheets is shown in U.S. Pat. No. 3,193,971. To preclude loss of concrete fill through vents while the concrete fill is in the pourable state, slots, as illustrated in U.S. Pat. Nos. 1,029,864 and 3,458,168 have been developed; herein, the slot is raised above the surface of the trough or bottom flute.

In each of the above identified U.S. patents, the vents formed are all disposed within the bottom flute or at the bottom of the trough. Additionally, the configuration of the slots and peripheral structure do not form nor are intended to form a physical lock intermediate the corrugated sheet and the cured filler. Accordingly, the corrugated sheets serve primarily as forms for the filler. That is, the combination of corrugated sheet and filler do not exhibit a synergistic effect of increasing the strength of the resulting unit above that of either individual component.

It is well known that in fluted or corrugated sheets, compression and tension failures occur first in the top or bottom flutes followed by a resulting failure or deformation of the interconnecting webs. To form slots or apertures within the bottom flutes further reduces the compression and tension strength of the bottom flutes resulting in earlier failure of the deck. Moreover, none of the prior art teaches the use of a fluted deck configuration which will tend to resist vertical separation of the concrete fill or filler material from the deck.

It is therefore a primary object of the present invention to provide a diaphragm having a fluted deck interlocked with a pourable hardenable filler.

Another object of the present invention is to provide a fluted deck which resists vertical separation between it and a supported pourable hardenable filler.

Yet another object of the present invention is to provide vent means for a fluted deck which does not reduce the compression and tension strength of the deck.

Still another object of the present invention is to provide a fluted deck having vents disposed within the webs interconnecting top and bottom flutes.

A further object of the present invention is to provide a plurality of vents within the webs of a fluted deck, which vents are in longitudinal alignment with the troughs of the deck.

A yet further object of the present invention is to provide downwardly directed venting louvers within the webs of a fluted deck.

A still further object of the present invention is to provide a means for promoting the curing of a pourable hardenable material disposed upon a fluted deck and covered by a non-porous sheet.

These and other objects of the present invention will become apparent to those skilled in the art as the description thereof proceeds.

The present invention may be described with greater specificity and clarity with reference to the following drawings, in which.

Figure 1:
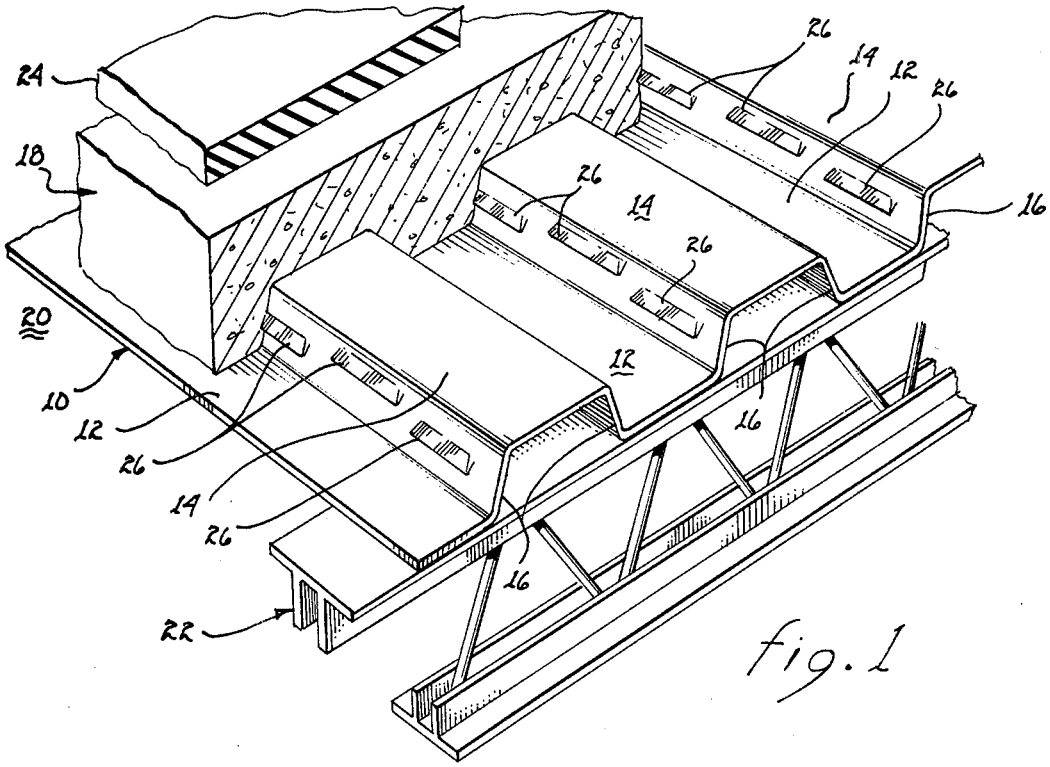
FIG. 1 is a partial cutaway view illustrating the components of a fluted deck supporting a cured concrete fill.

Referring to FIG. 1, there is illustrated a corrugated sheet or fluted deck 10 having bottom flutes 12 and top flutes 14 interconnected by webs 16. A pourable hardenable material, such as concrete fill 18, is poured upon fluted deck 10 and allowed to cure. After curing, the combination of fluted deck and concrete fill becomes a unitary structure known as a diaphram and identified by numeral 20.

The diaphragm is supported upon horizontal load bearing members or beams, such as built-up girder 22; alternately, the load bearing member may be an I beam or other structural member.

To insure complete curing of concrete fill 18, particularly when it includes insulating materials mixed therein and when a concrete fill is covered by a non-air porous insulating sheet 24, means must be provided within fluted deck 10 to accommodate evacuation and venting of water and water vapor.

In the prior art, venting was normally effected by forming slots or apertures within the bottom flutes of a corrugated sheet. This solution suffers from a major drawback. The compression and tension strength of a corrugated sheet is essentially a function of the strengths of the top and bottom flutes since they always fail first. Should either the top or bottom flutes be apertured or vented, their strengths are reduced with an ultimate reduction in the load sustaining capability of the corrugated sheet and reduction in shear values when used as a diaphragm.

Since the top and bottom flutes fail before the interconnecting webs fail, it follows that the webs are proportionally stronger than the top or bottom flutes. Hence, a reduction in strength of the webs would not affect the overall strength of the corrugated sheet if such reduction were equal to or less than the excess strength embodied in the webs.

Figure 2:
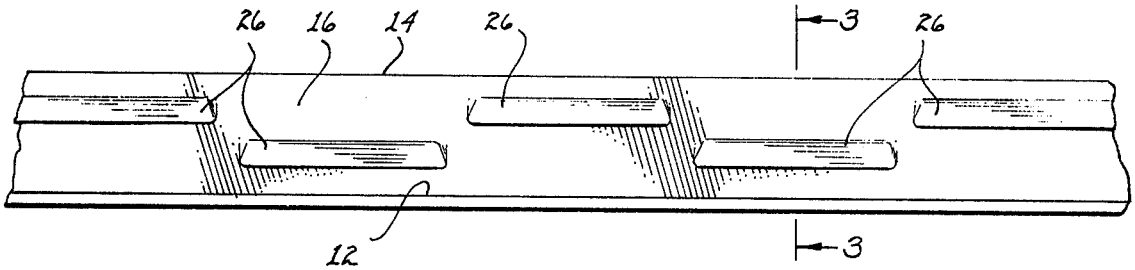
FIG. 2 is a side view of a web of the fluted diaphragm.
Figure 3:
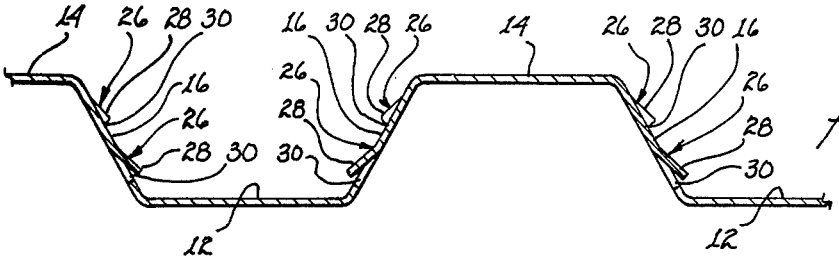
FIG. 3 is a cross-sectional view taken along lines 3—3, as shown in FIG. 2.

With this understanding of the strength distribution within the corrugated sheet or fluted deck, the vents embodied in the present invention will be described with joint reference to FIGS. 1, 2 and 3. For reasons stated above, the location of vents 26 to promote complete curing of concrete fill 18 are disposed within webs 16 of the fluted deck. Each vent 26 is developed as a downwardly oriented louver 28 which protrudes into the trough defined by opposed webs 16 and an interconnecting bottom flute 12. The louvers, being punched from the webs, define elongated slots 30 within the webs and through which water and water vapor may escape from the concrete fill.

The downwardly sloping orientation of louvers 28 with the lower edges thereof extending into the troughs of the fluted deck causes the concrete fill, while in a pourable state, to flow therearound. The flow of the pourable concrete fill results in the formation of an elongated depression in the cured concrete fill which has a sharply defined lower lip bearing against the longitudinal extremity of the louver.

The lip in each depression, bearing against the corresponding edge of each respective louver, creates a physical interlock intermediate concrete fill 18 and fluted deck 10, which interlock precludes vertical separation between the deck and the concrete fill. To whatever extent it may exist, depending upon the material from which the fluted deck is made, any adhesion between the concrete fill and the fluted deck adds additional resistance to separation therebetween. Because of the interlocking relationship between the concrete fill and the fluted deck, tests have indicated that a synergistic effect is obtained whereby the resulting structure is as much as two times stronger than known related prior art structures.

Figure 4:
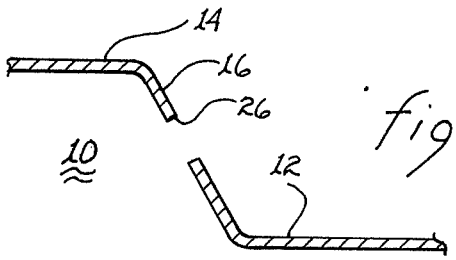
FIG. 4 is a partial cross-sectional view illustrating a web of the fluted deck vented by an aperture.

Generally, where the depths of the troughs in a fluted deck are $\frac{7}{8}$ inch or less deep, the fluted deck serves primarily as a form for the concrete fill. Such a trough depth limitation exists in the presently known prior art diaphragm structures because of the inability to achieve complete curing of the concrete fill. However, with deeper troughs of 1 5/16 inch or more, a significant strength increase is achieved since the inherent compressive load capability of concrete becomes more effectively utilized, provided complete curing of the concrete fill can be achieved. Because of the location of the louvered vents 26 within web 16, as shown in FIGS. 1, 2 and 3, or apertured vents within webs 16, as shown in FIG. 4, full and more complete curing of the concrete fill is no longer a problem even though the troughs are deep. Thus, the curing problems attendant vents disposed at the bottoms of the troughs are obviated.

In geographical areas where buildings are subjected to earthquakes and tremors from distant earthquakes, severe horizontal shear loads are imposed upon the buildings because of the relative movement of the earth with respect to the building. Similarly, in areas where high winds occur, the movement of the building with respect to the earth imposes severe horizontal shear loads upon the building. Unless such horizontal shear loads are withstood by the diaphragms of the buildings, damage thereto will occur with resultant safety hazards to the building and its occupants. The configuration of the present invention, as described above, incorporates the inherent strength of a fluted deck with that of the compressive load resistance of concrete into a unitary structure having a failure mode at a value substantially higher than any known related diaphragm structure.

Since the primary element responsible for the increased unitary strength of diaphragms constructed in accordance with the present invention is the vent or vents disposed within each of the webs, little additional cost produces substantial benefits of strength.

By experimentation and testing, it has been determined that the optimum total area of the vent openings should be equivalent to 1 $\frac{1}{2}$% of the projected area of the fluted deck. The total area of the vent openings per web is determined by dividing the total vent opening area by the number of webs per corrugated sheet. Through experimentation, it has been determined that a vent opening width of 0.030 inches is optimum from several standpoints; in example: it prevents the vent lengths from being too great in establishing the total optimum vent area; it is the greatest width possible with a degree of assurance that the sheet will not tear during formation of the vents; sufficient vent area is provided to insure venting of the water and water vapor from the concrete fill to promote more complete curing of the concrete fill; and, the indentation effected is sufficient to provide a structural interlock with the cured concrete fill deposited within the troughs of the fluted deck. With knowledge of the total vent opening area per web and the width of each vent opening, the total lineal length of the vents per web is determinable.

Considerations of manufacturing costs, strength criteria and adequate venting requirements suggest that in a 12 inch by 32 inch section of fluted deck having a web width of 1.82 inches, two rows of vents are preferable. Within each row, the vents are 2.5 inches in length and separated from one another by a distance of 2.212 inches. The bottom row should be located 0.375 inches or more above the bottom flute. Were the bottom row placed much closer to the bottom flute, the inherent strength attendant the longitudinal junction intermediate the bottom flute and the web might be reduced and tearing of the fluted deck may occur. The top row is preferably located 0.608 inches above the bottom row. The proximity of the top row to the top flute is not critical. The top and bottom rows are longitudinally offset, whereby partial overlapping of the top and bottom vents will exist.

For fluted decks having webs of a width greater or lesser than 1.82 inches, variation of the above defined parameters should be undertaken.

By experimentation, it has also been learned that failure, in the form of tearing of the vents, may occur if the terminal ends of the vents are sharply radiused. Accordingly, such failure is obviated by maintaining the radius at the terminal ends greater than a $\frac{1}{4}$ inch minimum.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A diaphragm for resisting horizontal shear loads imposed upon buildings, said diaphragm comprising:

a. a fluted deck secured to the framework of a building, said fluted deck including impervious top and bottom flutes and webs alternately interconnecting said top and said bottom flutes;

b. a moldable hardenable material deposited upon said fluted deck while said material is flowable;

c. louvers disposed in at least some of said webs in a vertically non-overlapping relationship for venting the louvered ones of said webs to promote curing of said material and for interlocking said cured material with the louvered ones of said webs of said fluted deck, said louvers being downwardly oriented to minimize loss of said material while it is flowable;

whereby, the horizontal shear load resistance of said top and bottom flutes remains unimpaired by apertures therein and curing by ventilation of said material in said fluted deck to lock said material therein is encouraged by said louvers while loss of said material through said louvers is minimized.

2. The diaphragm as set forth in claim 1 wherein a plurality of said louvers are disposed in each of said webs.

3. The diaphragm as set forth in claim 2 wherein each said bottom flute and the connected ones of said webs define a trough and wherein said trough is greater than $\frac{7}{8}$ inch deep.

4. The diaphragm as set forth in claim 3 wherein two rows of said louvers are disposed in each of said webs, said louvers in one row being horizontally separated from said louvers in another row.

5. The diaphragm as set forth in claim 4 wherein the bottom row of said louvers are at least $\frac{1}{2}$ of an inch above the adjacent one of said bottom flutes.

6. The diaphragm as set forth in claim 4 wherein said moldable hardenable material comprises concrete.

7. A deck structure for resisting horizontal shear loads, said structure including a concrete fill, said structure comprising in combination:

a. a fluted deck, said fluted deck including impervious top and bottom flutes and webs alternately interconnecting said top and bottom flutes; and b. downwardly oriented loubers disposed within at least some of said webs for venting the concrete fill to insure complete curing of the concrete fill and for physically locking the cured concrete fill with said fluted deck, said louvers within each said web being horizontally spaced to preclude overlap therebetween along a vertical axis.

8. The structure as set forth in claim 7 wherein a plurality of said louvers are disposed in each of said webs.

9. The structure as set forth in claim 8 wherein each of said webs includes two rows of said louvers, said louvers in one row being horizontally separated from said louvers in another row.

10. The structure as set forth in claim 9 wherein the lower one of said rows of louvers are at least $\frac{1}{2}$ of an inch above the adjacent one of said bottom flutes.

11. A fluted deck for use in a building to resist horizontal shear loads imposed upon the building, said fluted deck comprising in combination:

a. webs alternately interconnecting impervious top and bottom flutes;

b. downwardly oriented louvers disposed in at least some of said webs for venting said deck and for interlocking said vented webs with a moldable hardenable material to to deposited upon said fluted deck;

whereby, the horizontal shear load resistance of said top and said bottom flutes remains unimpaired and said louvers minimize loss of said material while promoting curing through ventilation to lock said material with said fluted deck.

12. The fluted deck as set forth in claim 11 wherein each of said webs includes a plurality of said louvers.

13. The fluted deck as set forth in claim 12 wherein each of said webs includes two rows of said louvers, each said louver in one row being horizontally displaced from a louver in another row.

14. The fluted deck as set forth in claim 13 wherein the lower one of said rows of louvers is at least 178 of an inch above the adjacent one of said bottom flutes.

15. A method for increasing the shear load resistance of buildings, said method comprising the steps of:

a. securing a fluted deck having webs alternately interconnecting impervious top and bottom flutes to the framework of the building;

b. pouring a concrete fill onto the fluted deck;

c. venting the concrete fill through vents located only in the webs of the fluted deck to insure curing of the concrete fill;

d. precluding vertical downward flow of the concrete fill through the vents; and e. interlocking the concrete fill with the vents disposed only on the webs of the fluted deck.

16. The method as set forth in claim 15 wherein said step of venting includes the step of venting each of the webs.

17. A method for attaching a moldable hardenable material deposited upon a fluted deck having webs alternately interconnecting top and bottom flutes, said method comprising the step of:

a. venting the moldable hardenable material through vents located only in the webs of the fluted deck;

b. precluding vertical downward flow of the material through the vents; and c. interlocking the vents disposed only on the webs of the fluted deck with the moldable hardenable material deposited upon the fluted deck.

18. The method as set forth in claim 17 wherein said step of venting includes the step of venting the moldable hardenable material through each of the webs.

19. A method for constructing a concrete fill supporting fluted deck having top and bottom flutes alternately interconnected by webs, said method comprising the steps of:

a. developing a vent in the webs only to promote curing of the concrete fill;

b. precluding vertical downward flow of the concrete fill through the vents while the concrete fill is curing; and c. establishing a protrusion in an interfering relationship with the concrete fill in at least some of the webs to interlock the cured concrete fill with the fluted deck.

* * * * *